US005170520A

United States Patent [19]

Milliken

[11] Patent Number: 5,170,520

[45] Date of Patent: Dec. 15, 1992

[54] SUSPENDABLE CRADLE

[76] Inventor: Scott Milliken, 8103 Carrollyn La., Flagstaff, Ariz. 86004

[21] Appl. No.: 856,532

[22] Filed: Mar. 24, 1992

[51] Int. Cl.[5] ..... A47D 7/04

[52] U.S. Cl. ..... 5/98.3; 5/102; 5/98.1; 297/273

[58] Field of Search ..... 5/102, 101, 103, 104, 5/120, 98.3, 98.1, 98.2, 94, 99.1, 122, 124, 922; 297/273, 274

[56] References Cited

U.S. PATENT DOCUMENTS

| | | | |
|---|---|---|---|
| 523,337 | 7/1894 | Ebert | 5/101 |
| 595,235 | 12/1897 | Amrock | 5/98.3 |
| 894,008 | 7/1908 | Ince | 5/98.3 |
| 1,198,130 | 9/1916 | Hutchings | 5/98.1 |
| 1,204,416 | 11/1916 | Doser | 5/120 |
| 1,376,476 | 5/1921 | Stepke | 5/98.3 |
| 1,746,098 | 2/1930 | Anderegg | 5/98.3 |
| 2,220,330 | 11/1940 | Hilger | 5/97 |
| 2,429,350 | 10/1947 | Farrand | 5/98.1 |
| 2,601,111 | 6/1952 | Foster | 5/98.3 |
| 3,049,728 | 8/1962 | Lund | 5/98.1 |
| 3,203,012 | 8/1965 | Roberts | 5/120 |
| 3,438,069 | 4/1969 | Long | 5/98.1 |
| 3,837,019 | 9/1974 | Hoff | 5/120 |
| 4,375,116 | 3/1983 | Murphy | 5/98.3 |
| 4,550,456 | 4/1985 | Allen | 5/102 |

FOREIGN PATENT DOCUMENTS

| | | | |
|---|---|---|---|
| 506995 | 11/1954 | Canada | 5/98.1 |
| 926156 | 4/1955 | Fed. Rep. of Germany | 5/98.1 |
| 258982 | 10/1926 | United Kingdom | 5/98.1 |

*Primary Examiner*—Alexander Grosz

[57] ABSTRACT

An infant cradle is formed from a rectangular piece of whole cloth. Portions are removed from the corners and the remaining edges of the cloth folded over and stitched to form elongated through sleeves along the sides and ends. The edges where the portions were removed are joined, e.g., by stitching or Velcro TM, to form an open-topped cloth basket with the through sleeves along the upper perimeter. Dowels are inserted in each sleeve and extend therebeyond where they overlap and are joined by eye-bolts which provide anchor points for supporting the cradle. Support straps attach to the anchors and extend upwardly to length adjustment buckles, one per anchor, and to centrally located loops, preferably one at each end of the cradle, which hook over one or more supports.

15 Claims, 4 Drawing Sheets

SUSPENDABLE CRADLE

FIELD OF THE INVENTION

The present invention concerns infant cradles and, more particularly, infant cradles having a basket attached to a frame adapted to be suspended from an overhead support.

BACKGROUND OF THE INVENTION

Countless designs for infant beds have been heretofore introduced into the market place. It is a natural objective of articles of this type to support an infant so that it may sleep or rest or be awake in comfort and security.

Prior art cradles are described, for example, in U.S. Pat. Nos. 523,337 to Ebert, 595,235 to Amrock, 894,003 to Ince, 1,204,416 to Doser, 1,376,476 to Stepke, 2,220,330 to Hilger, 3,203,012 to Roberts, 3,837,019 to Hoff and 4,550,456 to Allen, which are incorporated herein by reference. While these various arrangements provide infant cradles, they suffer from a number of disadvantages well known in the art, as for example, being complex to make and/or assemble, difficult to collapse into a small lightweight package of convenient shape for transport, comparatively expensive to manufacture and/or awkward to ship to the point of sale or, if by mail-order, to the purchaser. Accordingly, a need for improved cradles which overcome one or more of these or other deficiencies continues to exist.

As used herein, (i) the word cradle is intended to refer generally to infant beds which are adapted to be suspended from a support, as opposed to those infant beds which stand directly on the floor, (ii) the word "cloth" is intended to include any type of flexible woven or non-woven material which may be repeatedly folded without cracking or breaking, as for example, but not limited to fabrics, felts and meshes of various natural and/or man-made fibers, (iii) the word "cable" is intended to include ropes, cords, wires, chains, straps and/or other flexible support means of man-made and/or natural materials, or combinations thereof, and (iv) the word "joining panel" is intended to refer to a cloth piece of any shape in a cradle at a seam or corner or wear point to provide joining and/or strengthening. Plural forms of the above-defined words are intended to have corresponding meanings.

SUMMARY OF THE INVENTION

It is an advantage of the present invention to provide an improved means and method for infant cradles, especially cradles which are simple to manufacture and assemble, which collapse into a simple compact shape for shipment and storage and which provide a secure and comfortable support for an infant.

These and other advantages are provided by an infant cradle comprising, a cloth basket formed preferably of a single piece of cloth and having a bottom, sides and ends. The sides and ends are of different height. Elongated, open-ended sleeves are provided at upper edges of the sides and ends extending substantially along the length thereof. The sleeves are preferably formed by folding over the upper edge of the cloth and attaching it to itself, e.g., by stitching. The sides and ends are joined by seams or attachment means at the vertical corners of the basket. Joining panels may be provided extending from the bottom toward the upper edges where the sides and ends join. These panels may be part of one or both of the sides and ends or sewn to both ends and sides or part of or permanently attached to one and demountably attached to the other, e.g., by Velcro TM or snaps or other detachable joining means.

A supporting frame is provided made up of tubular side and end members (e.g., dowels) of lengths to pass through the open-ended sleeves. The dowels have holes therethrough near their ends for receiving combined joining pins and support anchors, one at each location where the side and end dowels overlap. Supporting cables attach to the support anchors.

In a preferred embodiment, a first supporting cable extends between anchors at opposite ends of one end dowel and a second supporting cable extends between anchors at opposite ends of a second end dowel. Each supporting cable has two length adjustment elements therein. Portions of the cables spaced slightly from each mid-point are joined so as to form a loop located substantially at the mid-point of each cable. The two length adjustment elements are preferably located one on each side of the loop. The supporting cables are preferably flat straps.

There is further provided a method for forming an infant support cradle comprising, providing a piece of whole cloth having a rectangular perimeter, cutting to remove portions from the cloth at corners thereof, forming tubular sleeves adapted to receive tubular frame members extending substantially along the length of each edge by folding and attaching a portion of the cloth to itself. In a preferred embodiment, there is further provided tubular frame members, one for each sleeve, and of lengths exceeding the length of each edge by an overlap amount, each overlap amount having therein a hole extending therethrough in a direction perpendicular to a longitudinal axis of the tubular frame member and located beyond the sleeves, wherein the holes overlap when the frame members are inserted through the sleeves. There are further provided pins for joining the tubular frame members through the holes, wherein the pins have anchor points coupled thereto for supporting the cradle when assembled.

It is desirable that, the cutting step provide joining panels which are formed in or attached to the cloth for joining portions of the cloth adjacent the cuts, thereby arranging the cloth into an open-topped basket. The panels are conveniently formed from portions of the cloth at the corners. In this way, a strong easily folded, easy to store cradle, is provided with almost no waste from the starting whole cloth.

The present invention will be more fully understood by reference to the figures listed below and description thereof which follows.

DETAILED DESCRIPTION OF THE DRAWINGS

Figure 1:
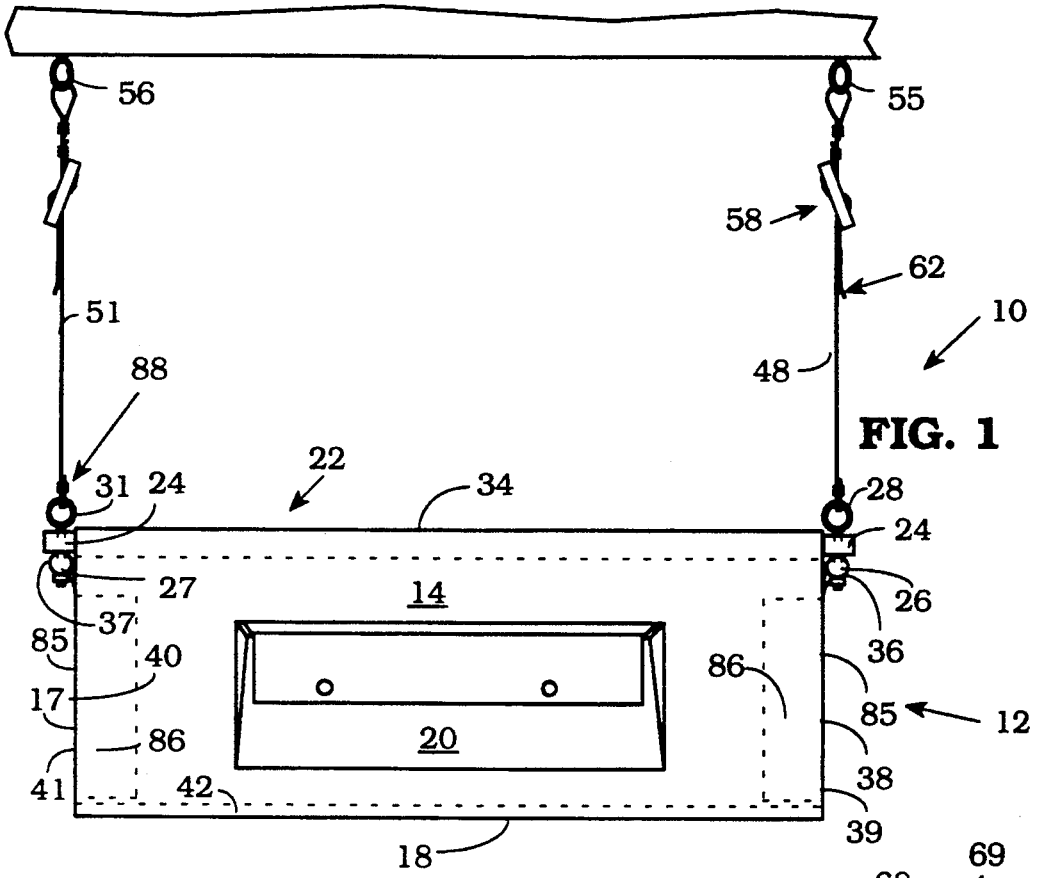
FIG. 1 shows a simplified side view and FIG. 2 shows a simplified end view of the cradle of the present invention, according to a preferred embodiment.
Figure 2:
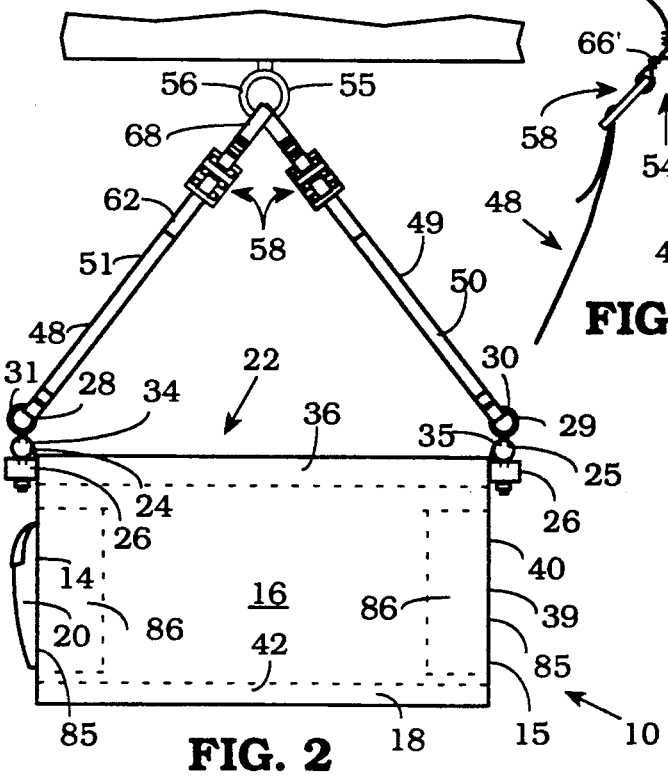

FIG. 1 is a simplified side view of cradle 10 according to a preferred embodiment of the present invention and FIG. 2 is an end view of the same cradle. Cradle 10 comprises open topped cloth basket 12 having longitudinal sides 14, 15 and transverse ends 16, 17, and bottom 18. Optional storage pocket 20 may also be included on one or more sides or ends of cloth basket 12.

Cloth basket 12 is suspended from frame 22 comprising rods or tubes 24–27 having reference numbers correponding to sides and ends 14–17, respectively. Wooden dowels are preferred for rods or tubes 24–27 because they are light in weight, strong, inexpensive and durable, but other substantially rigid materials may also be used. As used herein, the terms "dowel" or "dowels" are intended to include all other such materials, whether hollow or solid.

Dowels 24–27 pass through open-ended sleeves or pockets 34–37, respectively, formed at the upper edges of corresponding sides 14–15 and ends 16–17 of cloth basket 12. Dowels 24–27 are joined near their extremities by anchors (e.g., eye-bolts) 28–31, an anchor or other combination fastener and support cable attachment passing through dowels 24–27 adjacent respective corners 38–41 of cloth basket 12. An optional floor 42 such, as for example, a wooden or plastic panel or a rubber or plastic foam mattress may be provided on bottom 18, but this not essential.

Figure 3:
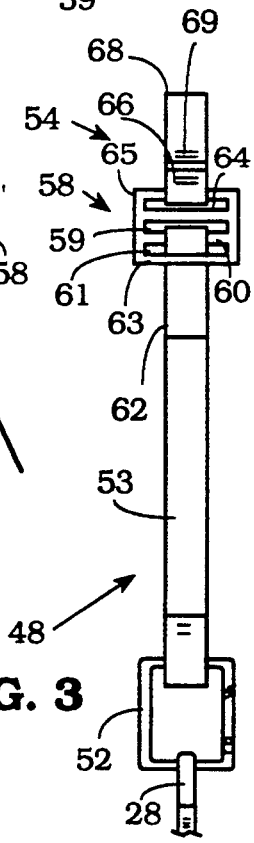

Anchors 28–31 are coupled to suspension cables 48–51, preferably one per corner, either directly as shown in FIGS. 1–2 or by use of connecting link or ring 52 (see FIG. 3). Quick-disconnect type connecting rings are desirable, as for example D-rings commonly used in mountaineering for attaching ropes or cables to a wide variety of things, but any type of link may be used, preferably demountable. Flat straps are preferred for cables 48–51 but any type of cable may be used. For convenience of explanation and not intending to be limiting, the invention is described for the use of flat straps as suspension cables 48–51. Those of skill in the art will understand based on the description herein how other types of cables may be used without undue experimentation.

Referring now to FIG. 3 where representative suspension cable 48 is shown, cables 48–51 desirably have two portions; lower portion 53 which attaches to coupling ring 52 or directly to anchors 28–31, and upper portion 54 which attaches to suspension points or rings 55, 56 from which cradle 10 is intended to be suspended. Suspension points 55, 56 are not a part of the present invention and may be of any type, as for example but not limited to, hooks or rings or loops attached to an overhead beam or limb or ceiling, or part of a stand adapted to support the suspended cradle. Any type of stable support will suffice.

Lower portion 53 and upper portion 54 of suspension cables 48–51 are joined by length adjustment means 58, as for example, a flat, multi-slotted buckle of a type which allows adjustment of the length of a cable when it is loose but which holds it tightly when tension is applied. Such buckles are well known in the art. In FIG. 3, a typical buckle of this type is illustrated in which lower portion 53 of cable 48 passes from a first side of buckle 58 through open slot 59 (second from the lower end), around cross-member 60 of buckle 58 and back out another slot 61 (first from the end) of buckle 58. Tag end 62 of strap 48 is captured between lower supporting portion 53 of strap 48 and the under side of buckle 58 or buckle cross-member 63 which is usually slightly roughened so as to grip the strap when tension is applied and prevent it from pulling around the cross-member 60 and out of buckle 58.

Figure 4:
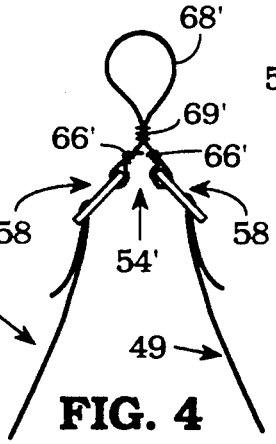
FIGS. 3 and 4 show further details of supporting cables used for suspending the cradle of FIGS. 1–2.

Upper portion 54 of strap 48 is conveniently inserted through slot 64 and around cross-member 65 of buckle 58 and then connected to itself, as for example by stitching or other attachment means 66. The other end of upper portion 54 is conveniently folded and attached to itself (e.g., by stitching 69) to form loop 68 for connection to support 55. While FIGS. 1–2 show support cables 48–51 as being identical and each having individual loops 68, FIG. 4 shows a further embodiment in which upper portion 54' is common to two suspension cables, e.g., cables 48, 49 and only one loop 68' is provided approximately at the center of upper portion 54'. This is conveniently done by folding upper portion 54' in the middle and stitching or otherwise attaching it to itself by connection 69'.

Further while this arrangement is illustrated in connection with cables coupled to the extremities of an end dowel (e.g., dowel 26 having cables 48, 49 coupled to anchors 24, 25), the same arrangement applies equally well if it is desired to use a common upper portion for cables coupled to extremities of a side dowel (e.g., dowel 24 having cables 48, 51 coupled to anchors 28, 31), or a combination thereof.

Figure 5:
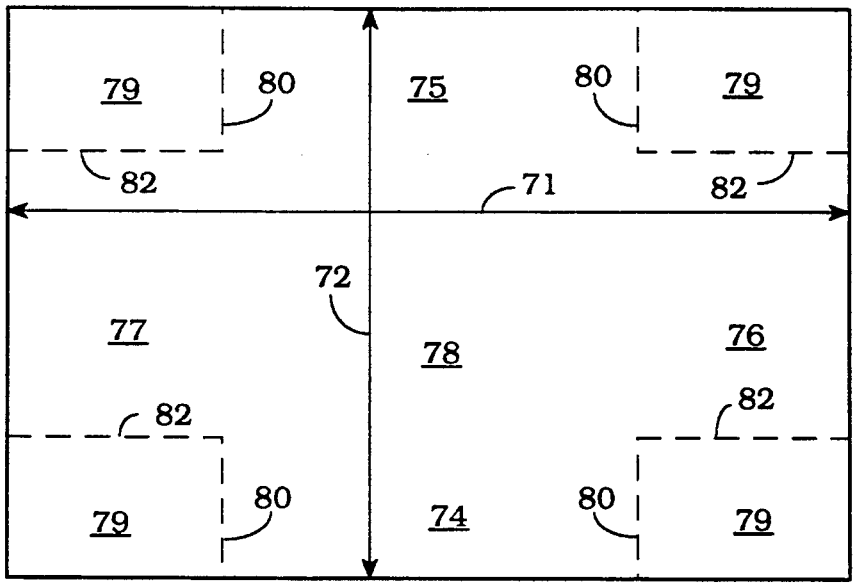
FIGS. 5–7 show in simplified form, plan views of a piece of whole cloth from which the basket portion of the present invention is cut and sewn, at different stages of manufacture.

FIGS. 5–17 illustrate the method of fabrication and assembly of the invented cradle and further features thereof, according to several embodiments. FIG. 5 shows a single piece of flat cloth 70 from which cloth basket 12 is desirably formed in the preferred embodiment. Single piece of cloth 70 has length 71 and width 72. For convenience of understanding of how basket 12 is formed from cloth 70, regions 74, 75 corresponding approximately to sides 14, 15, regions 76, 77 corresponding approximately to ends 16, 17 and region 78 corresponding approximately to bottom 18 are identified on FIG. 5.

FIGS. 5–13 illustrate an arrangement in which corner portions 79 are removed substantially in their entirety and then subsequently used to make reinforcing panels which are reattached near edges 80, 82 to join the sides and ends together. As will be subsequently explained in connection with FIGS. 14–17 other arrangements for joining edges 80, 82 in which portions 79 are removed only in part, are also useful.

Figure 6:
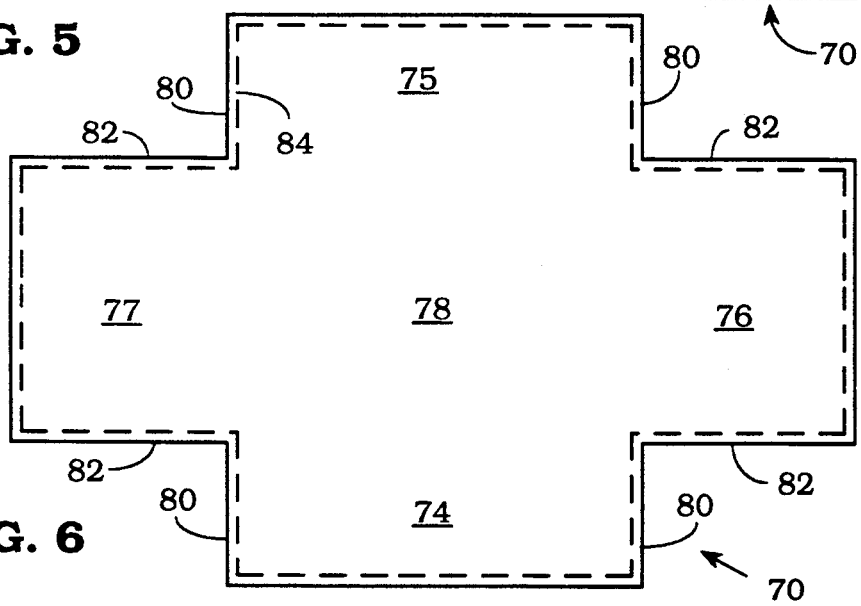

Referring now to FIG. 5, corner regions 79 are removed in whole or part from whole cloth 70 by cutting, for example, along cut lines 80, 82. Corner regions 79 are desirably rectangular with cut lines 80, 82 having unequal length. FIG. 6 shows cloth 70 after corners portions 79 have been removed so as to leave extension regions 74–77 protruding from central region 78. These corner portions are desirably retained and used to make reinforcing and joining panels as is later described, so that there is little or no waste material. Cut cloth panel 70 is desirably hemmed as indicated by dashed line 84, but this is not essential. For simplicity of illustrations, hem 84 is omitted in subsequent figures.

Figure 7:
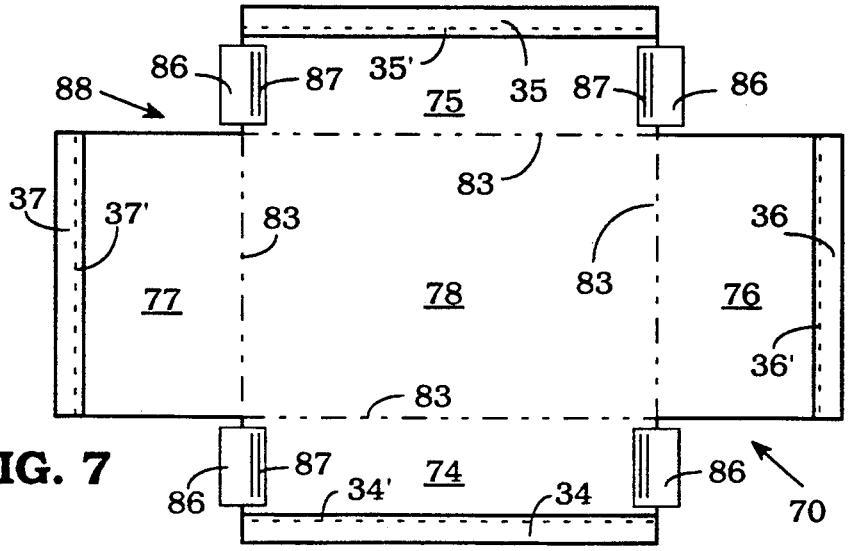

Referring now to FIG. 7, the outer edge of each extension region 74–77 is folded inward and stitched at stitch lines 34'–37' to form open sleeves or pockets 34–37 for receiving dowels 24–27. While stitching is the preferred method of forming pockets or sleeves 34–37, any means of folding and attaching the edges of cloth 70 to itself may also be used. Of course, outer edges of regions 74–77 of cloth 70 could be nailed or stapled to dowels 24–27 directly but this is not desirable because it makes it difficult to remove cloth basket 12 for washing, something which is frequently required with infant cradles.

Figure 8:
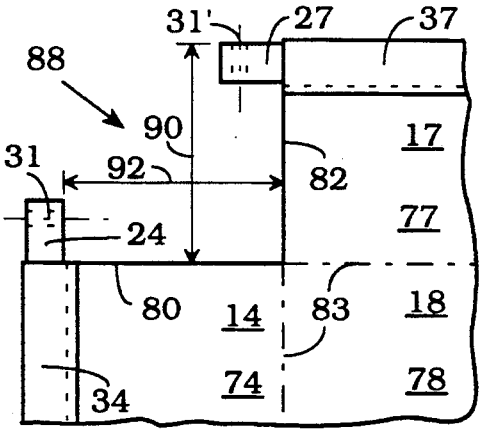
FIGS. 8–9 and 11–12 show, somewhat enlarged, further details of a corner of the cloth of the present invention with the supporting dowels in place, but prior to being folded and joined to form a cloth basket, and according to several embodiments.

FIG. 8 shows in greater detail corner 88 of cloth panel 70 of FIG. 7, indicating the relationship between cut lines 80, 82 and the arrangement of dowels 24, 27. Corner 88 is representative.

Figure 10:
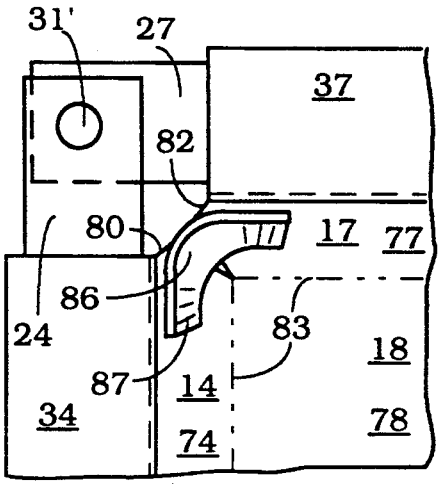
FIGS. 10 and 13 show, somewhat enlarged, views looking down on the top of a corner making up the cloth basket of the present invention and with the supporting dowels in place ready to be joined to a suspension anchor, according to several embodiments.

In order for cloth basket 12 to be uniformly supported by dowels 24–27 when assembled, it is desirable that cut lines 80, 82 have different lengths corresponding to the difference in the heights of the sides and ends to take into account the overlap of dowels 24–27. In the example shown in FIGS. 1–2 and 8, longitudinal side dowel 24 lies above transverse end dowel 27. Thus, sides 14, 15 must be taller than ends 16, 17 in order that when dowels 24–27 are inserted into sleeves 34–37 and overlapped where anchors 28–31 pass through, that there will be equal tension on sides 14, 15 and ends 16, 17. Assuming that the folds used to create sleeves 34–37 consume an equal length of cloth, then cut lines 80, 82 differ so that when dowels 24, 27 are inserted in sleeves 34, 37 distance 90 from cut line 80 to the top of dowel 27 is the same as distance 92 from cut line 82 to the bottom of dowel 24 (see FIG. 8). Then, when panels 74, 77 are folded along fold lines 83, end 14 and side 17 will be just the right length when dowels are over lapped as shown in FIGS. 1–2 and 10.

Dashed lines 83 in FIG. 7 indicate where cloth 70 is to be folded to make cradle basket 12. When cloth panel 70 is folded along fold lines 83, cut lines 80, 82 come together (taking into account any hems that may have been provided). Cut lines 80, 82 then form the vertical edges 85 of basket 12 at its corners (see FIGS. 1–2) extending from bottom 18 to near the upper edges or top of basket 12 where sleeves 34–37 are located.

While edges 80, 82 may be joined directly, a stronger construction is provided by use of joining or reinforcement panels 86 sewn or otherwise attached in each corner of basket 12 bridging between the sides and ends to join the vertical seams 85. Panels 86 are desirably attached either before, after or at the same time that sleeves 34–37 are formed, and stitching is particularly convenient. Stitching 87 is conveniently used to attach joining panels 86 to either side panel regions 74, 75 or end panel regions 76, 77 or a combination thereof while cloth 70 is still flat.

Figure 9:
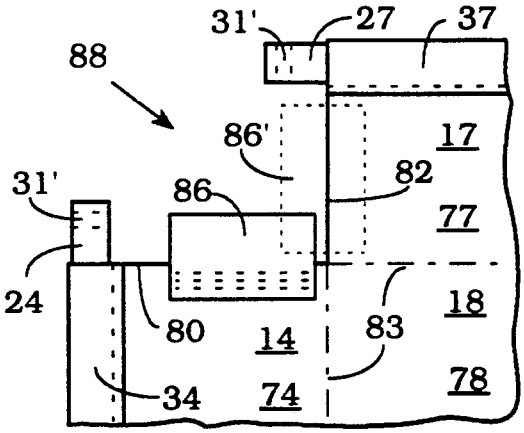

In FIGS. 7 and 9 show joining panel 86 as being first sewn to sides 74, 75 and for simplicity this arrangement is assumed in the description that follows. But, those of skill in the art will understand that this is not essential and that they may be first sewn to either ends or sides, as indicated for example, by dashed rectangle 86' in FIG. 9.

Figure 11:
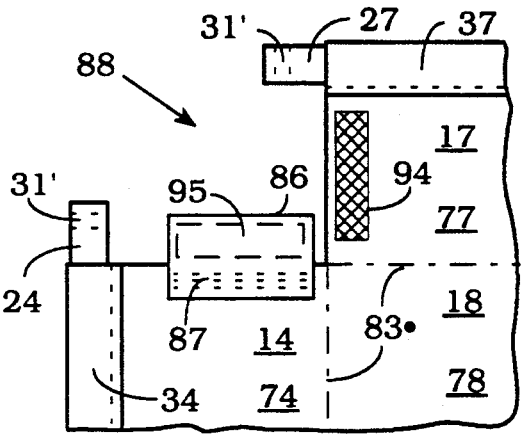

FIGS. 9 and 11 are view of representative corner 88 similar to FIG. 8 and with joining panel 86 attached to one part of the corner. Panel 86 is sewn or otherwise attached by about half its width to side 74 (and similarly to 75 at the other corners). Then cloth 70 is folded to bring cut lines 80, 82 together or into close proximity and the other half of joining panels 86 sewn or otherwise attached to end panel 77 (and similarly for 76 at the other corners).

FIG. 10 shows a view looking down approximately from the top of basket 12 toward corner 88 when cloth 70 has been folded along lines 83 to form cloth basket 12 and dowels 24, 27 inserted in sleeves 24, 37 so that holes 31' in dowels 24, 27 for anchor 31 are superimposed. FIG. 10 shows the situation when joining panel 86 has been attached by sewing to both side panel 74 and end panel 77. Once joining panel 86 has been sewn to the ends and sides, then cloth 70 can no longer be laid flat, although it will collapse into a pile of comparatively small thickness when the dowels are removed.

Figure 12:
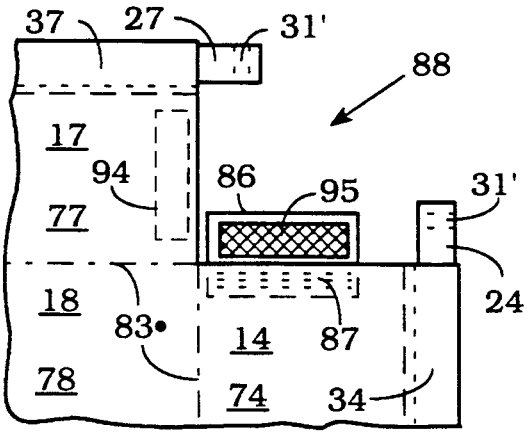
Figure 13:
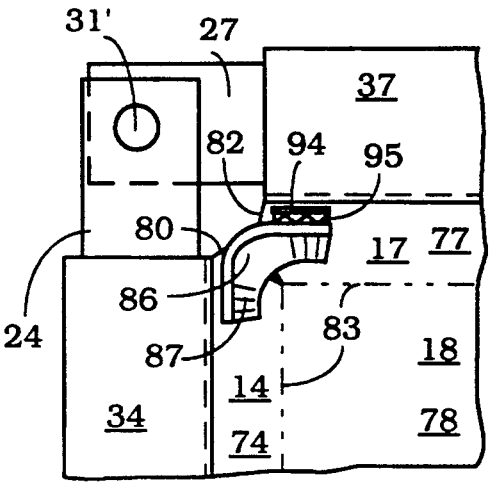

FIGS. 11–13 illustrate an arrangement which allows cloth 70 to be flattened and still have the benefit of the strengthening joining panels. FIG. 11 is similar to the view in FIG. 10 with joining panel 86 sewn to side panel 74 by stitching 87. However, rather than sew joining panel 86 to end panel 77, a two part separable material comprising for example, multiple hooks and loops is used. Velcro TM, is a well known example of such a joining material. First part 94 is attached (e.g., by sewing) to the inside of panel 77 (see FIG. 11) and second part 95 is attached to the outside of joining panel 86. FIG. 11 shows corner 88 looking from what will be the inside of basket 12 and FIG. 12 shows corner 88 looking from what will be the outside of basket 12, with cloth 70 still flat, i.e., not yet folded to into a basket shape. FIG. 13, which is similar to FIG. 10, shows the arrangement of the parts after cloth 70 has been folded into basket 12 and the Velcro (or other material of similar function) joined. The advantage of the arrangement of FIGS. 11–13 is that the Velcro joint may be separated and cloth 70 once again unfolded. With the dowels removed, basket 12 is substantially flat and may be easily rolled for storage or shipping, e.g., with the dowels grouped together in the center as a mandrel.

Figure 14:
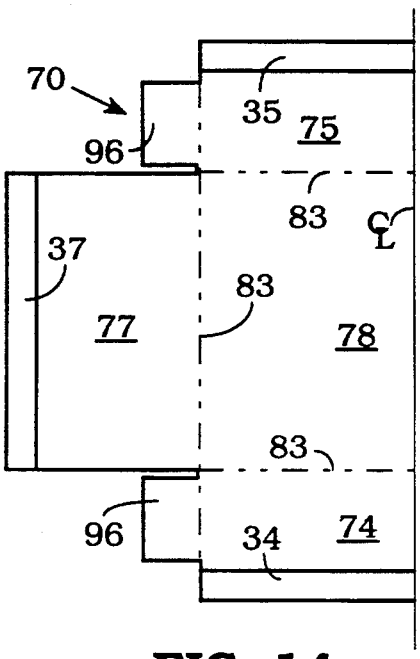
FIGS. 14 and 16 are views similar to FIG. 7 but of half the cloth to a centerline and showing further embodiments of the present invention.
Figure 16:
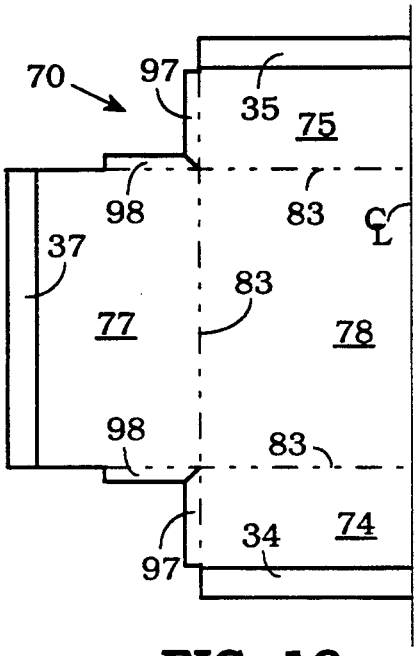
Figure 15:
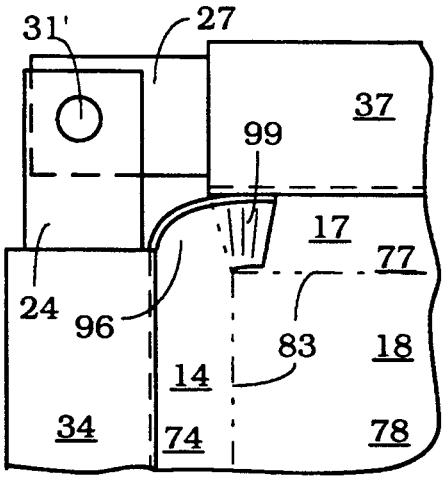
FIGS. 15 and 17 are views similar to FIGS. 10 and 13 but according to further embodiments of the present invention corresponding, respectively, to FIGS. 14 and 16.
Figure 17:
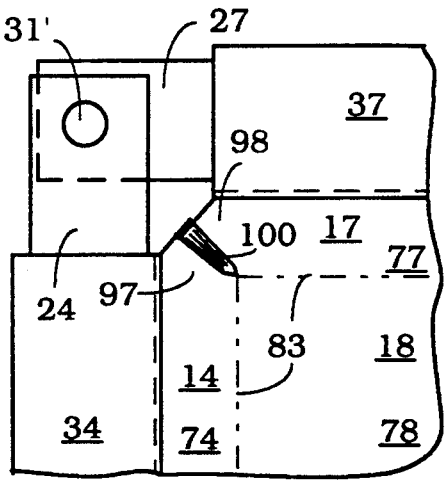

FIGS. 14 and 16 are views similar to FIG. 7 but of half of cloth 70 to a centerline and showing further embodiments of the present invention (the remainder of cloth 70 is symmetrical about the centerline). FIGS. 15 and 17 are views similar to FIGS. 10 and 13 but corresponding, respectively, to FIGS. 14 and 16.

Referring now to FIGS. 5 and 14, portions 96 of regions 79 are left in place attached to either sides 74. 75 or ends 76, 77. They form reinforcing and joining panels by which the sides and ends are joined. When basket 12 is formed by folding cloth 70 of FIG. 14 along fold lines 83, the arrangement of FIG. 15 is obtained in which panels 96 desirable join sides 74 to ends 77 in overlap region 99 by stitching or Velcro. FIG. 16 shows a somewhat similar arrangement but where two smaller panels 97, 98 are left in place at the ends of sides 74, 75 and ends 76, 77. FIG. 17 illustrates the situation when basket 12 is subsequently formed by folding cloth 70 of FIG. 16 along fold lines 83 and panels 97, 98 are joined in overlap region 100 by stitching or Velcro.

Having thus described the invention, those of skill in the art will appreciate that the present invention pro-vides an improved means and method for an infant cradle that is of simple construction, easy to fabricate from a single whole piece of cloth and other inexpensive materials and therefore economical to manufacture, of substantial strength to accommodate an infant, which disassembles into an especially compact shape for shipment and storage, and which is of light weight and convenient to use.

While the present invention has been described in terms of particular combinations of materials and shapes and fabrication steps and means for joining various parts, those of skill in the art will appreciate based on the description herein that other materials, combinations and variations may also be used. Accordingly, it is intended to include in the claims that follow such other choices, alternatives, materials, variations and combinations as will occur to those of skill in the art based on the description herein.

What is claimed is:

1. A suspendable infant cradle comprising, a supporting frame including longitudinal and transverse members coupled near their ends by attachment means passing through holes in the members, cable means coupled to the attachment means for suspending the cradle, a cloth basket formed from a single piece of cloth and open at the top and having a bottom joined to longitudinal sides and transverse ends, wherein the longitudinal sides and transverse ends have elongated, open-ended, pockets at their upper edges for receiving, respectively, the longitudinal and transverse members of the frame, and wherein the longitudinal pockets of the sides and ends are located at different distances from the bottom, and wherein vertical edges of the sides and ends extending upwardly from the bottom are joined by cloth reinforcing panels permanently attached to either the sides or ends and releasably attachable to the adjacent ends or sides by a material including hooks and loops on mating portions thereof.

2. The cradle of claim 1 wherein the cable means includes length adjustment means in lower first portions thereof, and, in upper second portions thereof, one or more loops for attaching the cradle to one or more supports from which the cradle is adapted to hang.

3. The cradle of claim 2 wherein the supporting cable means comprises a first supporting cable coupled to the attachment means at a first end of the cradle and a second supporting cable coupled to the attachment means at a second end of the cradle, wherein each supporting cable comprises two lower portions and one upper portion, wherein each lower portion is joined to an upper portion by length adjustment means.

4. The cradle of claim 3 wherein upper portions of the first and second supporting cables comprise supporting loops.

5. The cradle of claim 4 wherein the supporting loops are formed by folding each of the second portions of the cables into a loop centrally located in the second portion and joining parts of the second portion thereby brought into proximity by the loop.

6. The cradle of claim 5 wherein the parts are joined by sewing or riveting or both.

7. The cradle of claim 1 wherein the cable means includes length adjustment means in lower first portions thereof and, in upper second portions thereof, one or more loops for attaching the cradle to one or more supports from which the cradle is adapted to hang, wherein the supporting cable means comprises substantially flat straps and the length adjustment means comprises substantially flat slotted members coupled to first or second portions of a supporting cable and having at least two slots through which the other of the first or second portions of the supporting cable passes and which locks the cable in place when tension is placed thereon relative to the slotted member.

8. A suspendable infant cradle comprising, a cloth basket formed of a single piece of cloth and having a bottom and opposed longitudinal sides of a first height and opposed transverse ends of a second height different from the first height, coupled to the bottom, and elongated, open-ended pockets formed at upper edges of the sides and ends from a secured fold thereof extending substantially along the length thereof, cloth reinforcing and joining panels permanently attached to either sides or ends and releasably attachable to the adjacent ends or sides and extending from the bottom toward the upper edges for detachably joining the sides and ends, and first and second side tubular members of lengths to pass through the open-ended pockets of the longitudinal sides, and third and fourth end tubular members of lengths to pass through the open-ended pockets of the transverse ends, wherein the members have holes therethrough near their ends for receiving combined joining pins and support anchors, one at each location where the side members and end members overlap, and cables coupled to the support anchors for suspending the cradle.

9. The cradle of claim 8 wherein the cables comprise first and second supporting cables attached to opposed pairs of support anchors.

10. The cradle of claim 9 wherein the first supporting cable extends between anchors at opposed ends of a first end member and the second supporting cable extends between anchors at opposed ends of a second end member, and wherein each supporting cable has two length adjustment elements therein.

11. The cradle of claim 10 wherein each of the first and second supporting cables has portions spaced slightly from a mid-point of the cable joined so as to form a loop located substantially at the mid-point of the cable, and wherein the two length adjustment elements are located one on each side of the loop.

12. The cradle of claim 11 wherein the cables are substantially flat straps.

13. The cradle of claim 9 further comprising, detachable links located between the anchors and cable ends coupled to the anchors.

14. The cradle of claim 8 wherein the joining panels releasably attach to sides or ends by means of a detachable joining means comprising loops and hooks on mating portions thereof.

15. The cradle of claim 14 wherein the detachable joining means comprises two detachable mating parts attached respectively to opposed surfaces of the cradle.

* * * * *